United States Patent [19]

Melan et al.

[11] Patent Number: 5,018,923

[45] Date of Patent: May 28, 1991

[54] AUTOMATED BRICKLAYING APPARATUS

[75] Inventors: Corneille Melan, Luxembourg; Jeannot Konsbruck, Berbourg; Andre Kremer, Leudelange, all of Luxembourg

[73] Assignee: Paul Wurth S.A., Luxembourg, Luxembourg

[21] Appl. No.: 421,170

[22] Filed: Oct. 12, 1989

[30] Foreign Application Priority Data

Nov. 9, 1988 [LU] Luxembourg ..... 87381

[51] Int. Cl.[5] ..... E04G 21/16

[52] U.S. Cl. ..... 414/10; 182/62.5; 182/63; 182/128; 182/148; 266/281; 52/749; 414/744.5

[58] Field of Search ..... 414/931, 10, 11, 12, 414/744.3, 744.5, 744.6; 182/62.5, 63, 65, 128, 148; 266/281; 187/2, 9 E; 52/749

[56] References Cited

U.S. PATENT DOCUMENTS

| | | | |
|---|---|---|---|
| 1,531,982 | 3/1925 | Sago | 182/62.5 X |
| 1,546,698 | 7/1925 | Zoll et al. | 182/62.5 |
| 3,735,546 | 5/1973 | Newman | 414/10 X |
| 3,757,484 | 9/1973 | Williamson et al. | 414/10 X |
| 3,853,204 | 12/1974 | Smith | 182/128 |
| 4,491,449 | 1/1985 | Hawkins | 414/10 |
| 4,688,773 | 8/1987 | Legille et al. | 414/10 X |
| 4,708,562 | 11/1987 | Melan et al. | 414/10 |
| 4,720,226 | 1/1988 | Legille et al. | 414/10 |
| 4,758,036 | 7/1988 | Legille et al. | 294/86.4 |
| 4,765,789 | 8/1988 | Lonardi et al. | 414/10 |
| 4,786,227 | 11/1988 | Kremer et al. | 414/10 |

FOREIGN PATENT DOCUMENTS

| | | | |
|---|---|---|---|
| 3413806 | 1/1985 | Fed. Rep. of Germany | 266/281 |
| 1493991 | 9/1967 | France | 182/62.5 |
| 2590197 | 5/1987 | France | 414/744.5 |
| 0263979 | 4/1988 | Luxembourg . | |
| 421610 | 11/1974 | U.S.S.R. | 266/281 |
| 2106074 | 4/1983 | United Kingdom | 414/744.5 |

*Primary Examiner*—Robert J. Spar
*Assistant Examiner*—James T. Eller
*Attorney, Agent, or Firm*—Fishman, Dionne & Cantor

[57] ABSTRACT

Automated installation for the laying for masonry on a wall, especially of a converter, comprising an operating station with a work plateform movable vertically inside the enclosure and capable of rotating about the vertical axis of the latter, areas for the simultaneous storage of two pallets of bricks on the platform, a robot for handling and laying the bricks, a monitoring and control station, retractable props for stabilizing the operating station and a device for raising and lowering pallets of bricks. The entire operating station is supported by a telescopic mast mounted on a turntable of a movable floor which is located outside the enclosure and with which the operating station forms a retractable self-propelled or towable unit.

9 Claims, 4 Drawing Sheets

AUTOMATED BRICKLAYING APPARATUS

TECHNICAL FIELD

The present invention relates to an automated installation for the laying of masonry on a wall, and more particularly for laying a refractory lining on the inner wall of a metallurgical converter.

BACKGROUND OF THE INVENTION

Various robotised installations have recently been proposed for automatically laying a refractory lining on the inner wall of a metallurgical converter. Of these robotised installations, a distinction can be made essentially between two categories, namely those in which the depalletisation of the bricks is carried out inside the converter as in U.S. Pat. No. 4,720,226, the disclosure of which is incorporated herein by reference and those in which depalletisation is carried out outside the converter as in U.S. Pat. No. 4,765,789, the disclosure of which is incorporated herein by reference. Each of these categories of installation has its own advantages and disadvantages. Thus, for example, the advantage of the installations with depalletisation inside the enclosure is relatively rapid execution, since apart from the relatively short idle times necessary for changing the pallets, the two types of brick required are permanently available on the work platform.

The advantage of the installations with depalletisation on the outside is a reduction in the congestion on the platform, thus contributing to greater safety of the supervisory personnel located on the latter and/or making it possible to reduce the surface area of the platform, so that the installation can be used for repairing both large converters and converters of smaller size, and so that the bricklaying can also be carried out in the upper part of a converter where the diameter decreases progressively. Unfortunately, the installations with depalletisation on the outside require sophisticated hoists and complex procedures in order selectively to bring the two types of brick onto the platform at the workrate of the robot laying them.

The document U.S. Pat. No. 4,786,227, the disclosure of which is incorporated herein by reference relates to an installation with a reduced congestion of the work platform as a result of the use of a robot which no longer executes sweeps above the surface of the platform and which consequently makes it accessible to the personnel in complete safety.

SUMMARY OF THE INVENTION

The object of the present invention is to provide an apparatus which overcomes some of the above disadvantages and which, with the aim of being able to profit as much as possible from the possibility of use in different converters, can be transported from one iron and steel operations site to another easily and quickly.

To achieve this object, the invention provides an installation which, according to a preferred embodiment, is characterized in that the entire operating station is carried by a single telescopic mast mounted on a turntable of a movable floor which is located outside the enclosure and with which the operating station forms a retractable self-propelled or towable unit.

According to a first embodiment, the operating station is movable along the telescopic mast in order to be set down on the turntable of the movable floor for the purpose of transporting it. The operating station, once lowered by means of the telescopic mast and subsequently set down on the turntable, thus forms a compact unit with the movable floor on wheels, which can easily be transported from one iron and steel operations site to another by road.

The means for raising and lowering the pallets preferably comprise an elevator which is movable between the said turntable and the platform and which is suspended on the cables of winches provided in the operating station. This elevator is designed to receive at least one pallet carrier cage which consists of a lower compartment for receiving the full pallets and of an upper compartment for receiving empty pallets and which is carried in the elevator by means of a lifting device which can consist of a pantograph actuated by a tensioning jack. To make the movement of the pallets easier, the floor of each compartment is preferably formed by a sliding track with runners or rollers or by telescopic sections.

The upper compartment is preferably partially open towards the top and fastened to the lower compartment by means of a hinge, thus making it possible to arrange the storage areas partially in the upward path of the pallets.

The elevator preferably possesses, on two opposite sides, rolling runners travelling along extendable guide rails.

The turntable of the movable floor possesses an elevator loading and unloading station consisting of a movable table capable of revolving on guide rollers round the turntable along its peripheral edge, and intermediate sliding tracks in the extension of the upper and lower compartments of the pallet carrier cage.

The robot for handling and laying the bricks is mounted at the end of a telescopic boom extendable horizontally in the radial direction.

According to a preferred embodiment, this robot comprises a device for grasping at least one brick, connected to the telescopic boom by means of two articulated arms with three vertical parallel pivot axes and of a vertical telescopic rod. By means of this telescopic rod, the robot can stack several rows of bricks, without the operating station having to be raised.

In the two storage areas, the pallets are deposited on movable boards which are movable on the platform in parallel with the telescopic boom two within reach of the robot, thus allowing the latter to carry out both the depalletisation and the laying of the bricks, without the need for an automatic depalletisation mechanism provided in the known installations.

The monitoring and control station is located at the top of the operating station and can occupy the entire horizontal surface of the latter.

Other particular features and characteristics will emerge from the description of an advantageous embodiment given below by way of illustration, with reference to the accompanying drawings.

DETAILED DESCRIPTION OF THE INVENTION

DETAILED DESCRIPTION OF THE INVENTION

Figure 1:
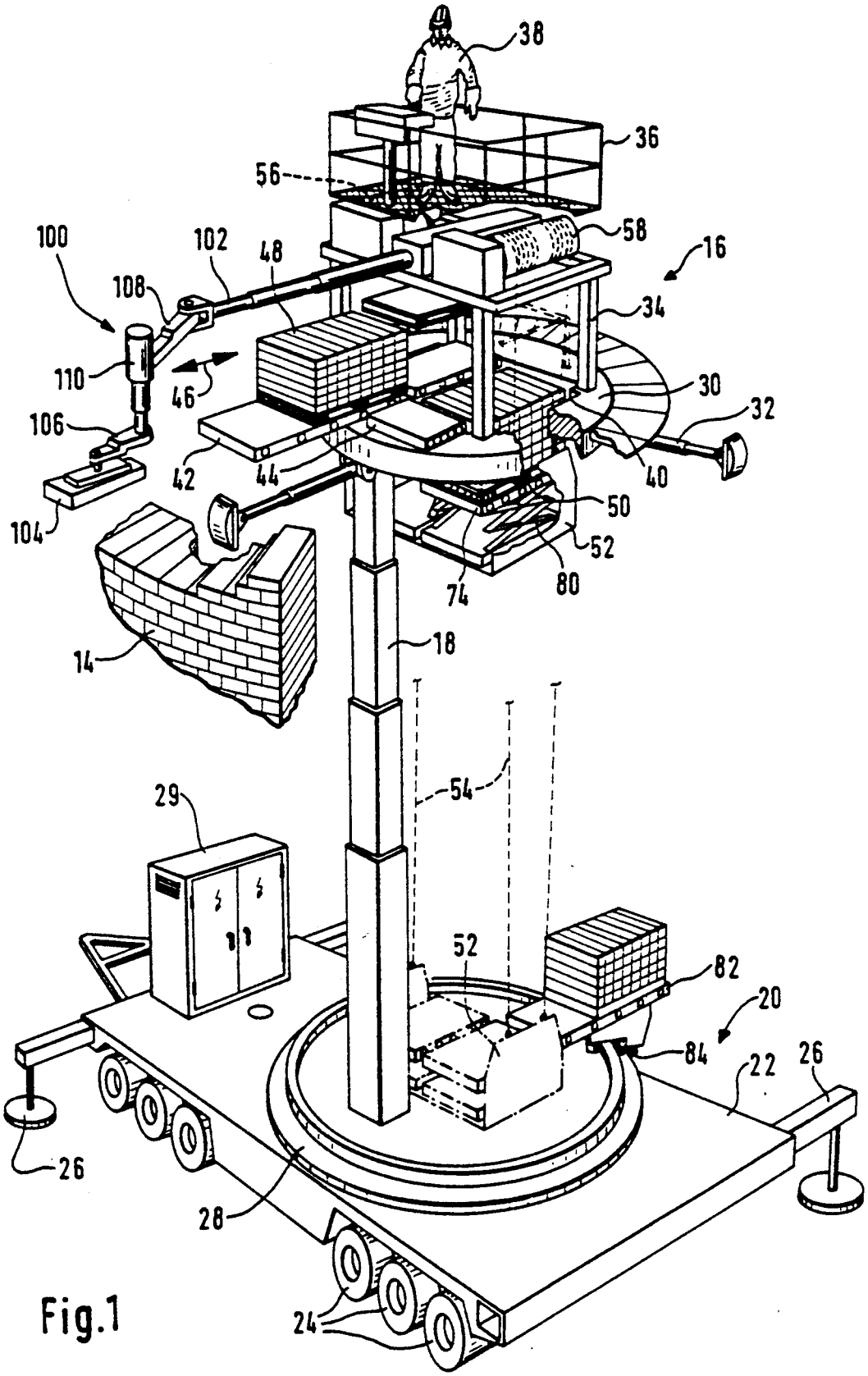
FIG. 1 shows a general perspective view of an installation according to the present invention.
Figure 2:
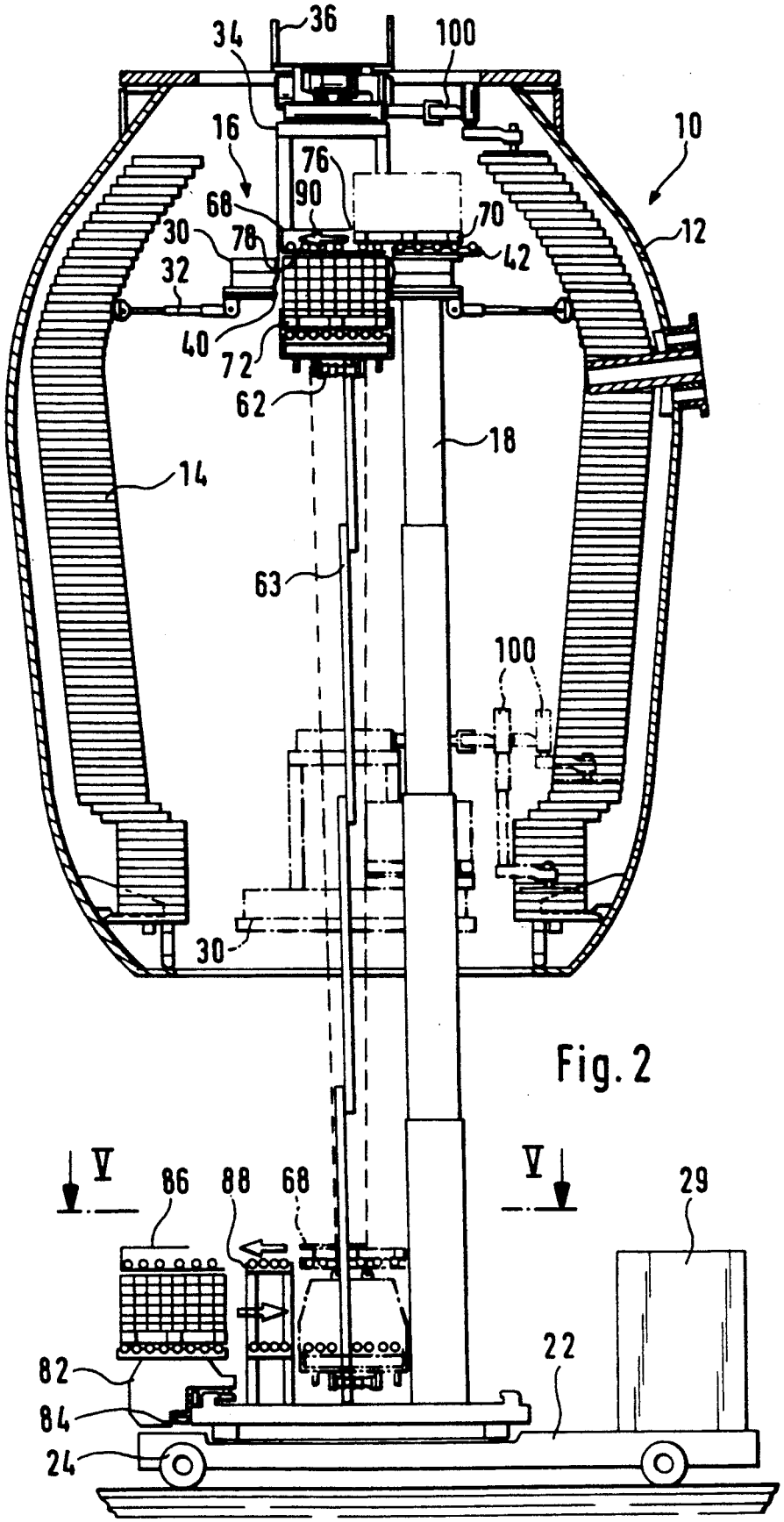
FIG. 2 shows a vertical section through a first type of converter with an installation according to FIG. 1.

FIG. 2 shows, in vertical section, a converter 10 represented by its metal casing 12 and its inner refractory lining 14, which has to be renewed at regular intervals. This purpose is served by the installation which is provided by the present invention and which is shown partially in section in FIG. 2 and in perspective in FIG. 1. However, not all the elements have been shown in this FIG. 1, to avoid overloading the perspective view.

This installation essentially comprises an operating station 16 designed to be moved vertically inside the converter 10 by means of a single powerful telescopic mast 18 which is actuated hydraulically and which is carried by a movable floor or transport unit 20. In the example illustrated, this transport unit 20 consists of a trailer 22 mounted on wheels 24 and having extendable stabilizing and leveling props 26. The reference 29 denotes an air-conditioned cabin containing the electrical controls.

Instead of mounting the installation on a towable trailer, it is also possible to equip the movable floor with a drive unit and with the accessories necessary to make it into a self-propelled unit.

The operating station 16 and its telescopic supporting mast 18 are carried on the trailer 22 by means of a turntable 28 actuated by automatic controls and by means (not shown) in order to rotate the operating station 16 about the vertical axis and thereby gain access to the entire perimeter of the converter 10. This arrangement distinguishes the installation from the known installations inasmuch as these were supported by several stationary telescopic masts and the operating station was driven in a rotational movement in relation to the supporting masts.

The operating station 16 possesses a platform 30 equipped with several, in this particular case three, retractable radial props 32 designed to bear on the refractory masonry for the purpose of stabilizing the operating station 16. Located on the platform 30 is a frame 34 for supporting all the working instruments as well as a control and monitoring station 36 giving an operator 38 the requisite degree of safety.

The installation illustrated is of the type with depalletisation on the inside, and for this purpose, the platform 30 must be designed to receive two pallets of bricks. In fact, it must be remembered that it is necessary to provide at least two different types of brick in order to repair the refractory masonry 14, because the converters do not all have the same diameters and the diameter of each converter varies according to its height. Two or more standard types of brick of different sizes must be provided, and by carefully alternating the choice of these types, the desired curvatures are achieved.

The platform 30 is therefore equipped with a central orifice 40 of such dimensions as to allow the passage of two pallets of bricks.

The platform 30 also possesses two areas placed next to one another for the intermediate storage of the pallets. These storage areas are defined by two movable boards 42, 44 (the board 44 being shown only partially in FIG. 1) which are mounted on runners or rollers so as to be movable in relation to the platform 30 in the direction represented by the arrow 46.

The reference 48 denotes a pallet full of bricks, which is placed on the board 42, while the reference 50 denotes a pallet being raised through the orifice 40 in order to be placed on the board 44.

Pallets of bricks are raised onto the platform 30 by means of an elevator 52 attached to cables 54 which are wound around two winches 56, 58 supported by the frame 34. Moreover, the operator 38 can also regain his station 36 by means of this elevator.

To prevent pendulum movements of the elevator 52, this is equipped, on two opposite sides, with a group of guide rollers 60, 62 (see FIGS. 2, 3 and 5) which travel along extendable guide rails 63 extending between the turntable 28 and the platform 30 and not shown in FIG. 1. This system for guiding the elevator 52 can be of the type illustrated in more detail in U.S. Pat. No. 4,765,789.

Figure 5:
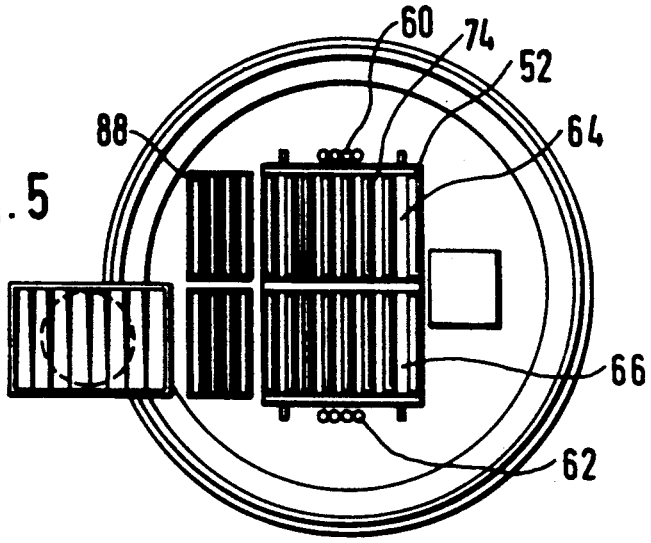
FIG. 5 is a horizontal section in the plane V—V of FIG. 2.

To make it easier to handle full pallets and empty pallets, it is preferable to make use of a pallet carrier cage similar to that described in U.S. Pat. No. 4,720,226. The elevator 52 therefore contains two pallet carrier baskets 64, 66 arranged side by side, as shown in FIG. 5. In fact, each of the baskets 64, 66 is composed (see FIGS. 2 and 3) of an upper compartment 68 which is intended for receiving an empty pallet 70 and which, with the bottom of the basket, defines a lower compartment intended for receiving a full pallet 72. The floors of the upper compartment 68 and lower compartment consist, of a raceway with rollers 74 (see also FIGS. 1 and 5) to make it easier for the pallets to slide. The upper compartment 68 is partially open towards the top, as shown at 76, and furthermore this compartment is attached to the rest of the basket by means of a hinge 78, to allow this compartment 68 to pivot about the horizontal axis of this hinge 78. The usefulness of this special design of the compartment 68 will emerge later from the description of the mode of operation.

Figure 3:
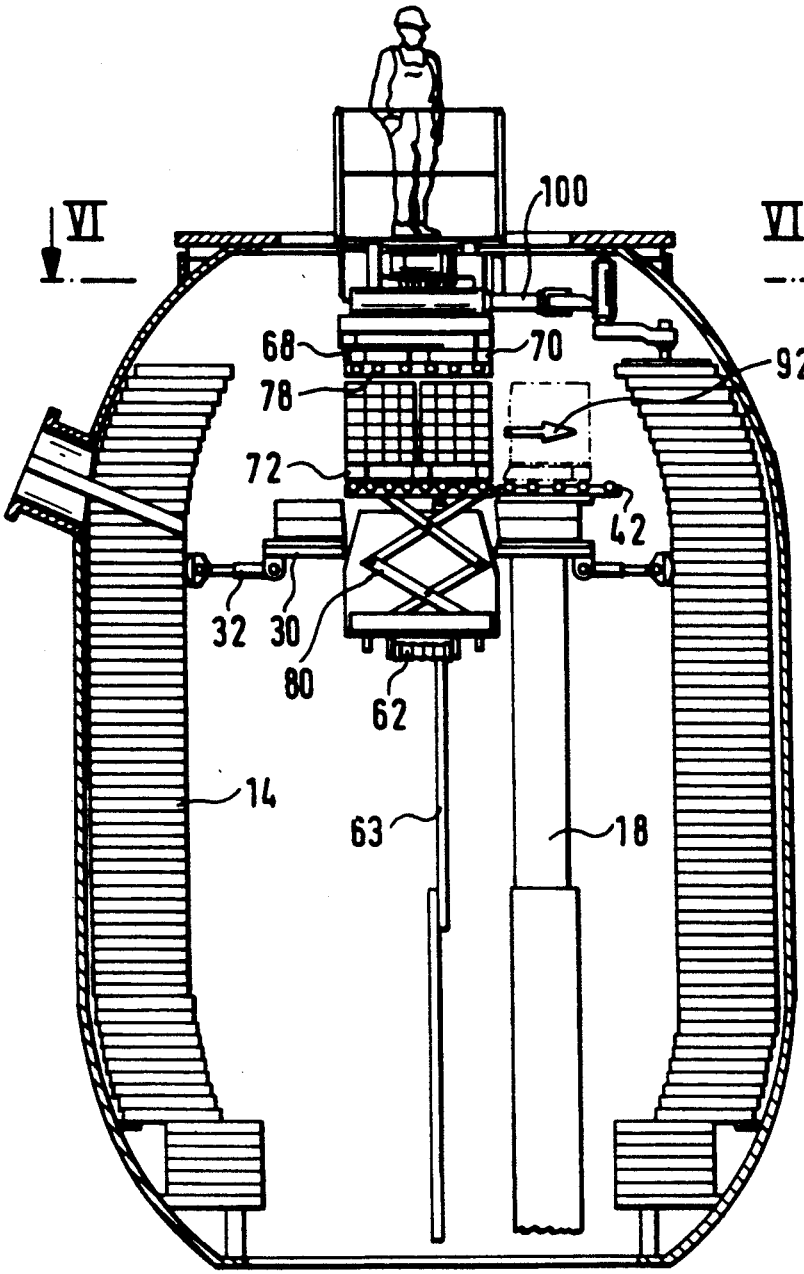
FIG. 3 shows a vertical section through a second type of converter with the operating station in the working position.

Each of the pallet carrier baskets 64, 66 is carried in the elevator 52 by means of a lifting system which, as shown in FIGS. 1 and 3, can consist of a kind of pantograph 80 associated with a tensioning jack (not shown) for lifting the pallet carrier baskets 64, 66. In the end-of-travel position of the elevator 52 according to FIG. 2, this lifting system makes it possible to hoist each of the baskets 64, 66 level with the platform 30, as shown in FIG. 3.

The loading of the pallet carrier baskets 64, 66 with full pallets and the removal of the empty pallets are carried out by means of a table 82 (see FIGS. 1 and 2) which is mounted by means of rolling runners 84 on the peripheral edge of the turntable 28 and which can revolve round the latter. By means of this table 82, the full pallets can be brought by trucks to a readily accessible location on the trailer, independently of the orientation of the operating station 16. The pallets can therefore be unloaded from a truck and placed directly on the table 82, after which the latter will rotate about the turntable 28 until it is in a position of alignment with one of the baskets 64, 66 of the elevator 52 (see FIG. 5).

It is possible to provide, on the table 82, a basket 86 similar to the baskets 64, 66, with an upper compartment for receiving the empty pallets and a lower compartment for the full pallets. In this case, to make loading an unloading easier, it is preferable to arrange the support of the table 82 in such a way that it can rotate about its vertical axis.

In front of the elevator 52 is a transfer device 88 (see FIGS. 2 and 5) with a double upper and lower sliding track aligned respectively with the upper compartment and the lower compartment of each of the pallet carrier baskets 64, 66.

The raising of the full pallets from the turntable 28 to the operating station 16 and the lowering of the empty pallets take place by means of outward and return trips of the elevator 52 between the positions represented by thin lines and by thick lines in FIG. 2. When the operating station 16 is at a level of small cross-section of the converter, as in FIG. 1, or when the diameter of the converter is relatively small, as with that illustrated in FIG. 3, the position of the pallets 70 on the boards 42 and 44 partially overlaps with the orifice 40 of the platform 30. This is why the upper compartment 68 of each of the baskets 64, 66 is partially open towards the top at 76, thereby allowing the elevator 52, at the upper end of its travel, to rise as far as the position shown in FIG. 2, in which the compartment 68 is in alignment with the empty pallet 70 on the board 42, thus allowing this pallet 70 to be slid into this compartment 68, this movement being symbolized by the arrow 90 in FIG. 2.

As soon as the empty pallet 70 is in the compartment 68, the basket now containing a full pallet 72 and an empty pallet 70 is lifted through the orifice 40 as a result of the extension of the pantograph 80, into the position illustrated in FIG. 3, in which the full pallet 72 is aligned with the corresponding board 42. This full pallet 72 can thereupon be slid onto the board 42, this being symbolized by the arrow 92 in FIG. 3. Once the full pallet is completely out, the elevator 52 will once again descend with the empty pallet 70, in order to unload the latter into the basket which is waiting on the table 82 with a new pallet which will be loaded into the elevator 52 in order to be raised onto the platform 30.

The robot for handling and laying the refractory bricks is shown diagrammatically at 100 (see more especially FIG. 1). This robot is mounted at the end of a telescopic boom 102 which is supported by the frame 34. The robot 100 comprises a brick-grasping device 104 which can be of the type described in U.S. Pat. No. 4,758,036, the disclosure of which is incorporated herein by reference or more simply, as in the example illustrated, a suction means. This suction means is connected to the boom 102 by means of two arms 106, 108 articulated relative to one another and relative to the suction means 104 and to the boom 102, these joints defining three vertical parallel pivot axes. The connection between the two arms 106, 108 is made by means of a telescopic rod 110 which allows the suction means 104 to move vertically in relation to the boom 102.

Figure 6:
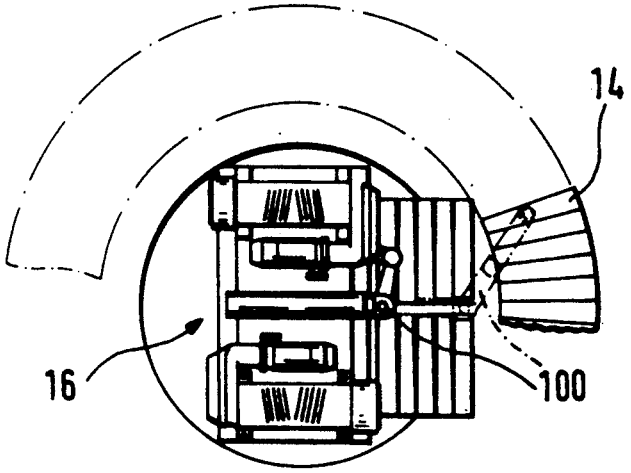
FIG. 6 shows a horizontal section in the plane VI—VI of FIG. 3.
Figure 7:
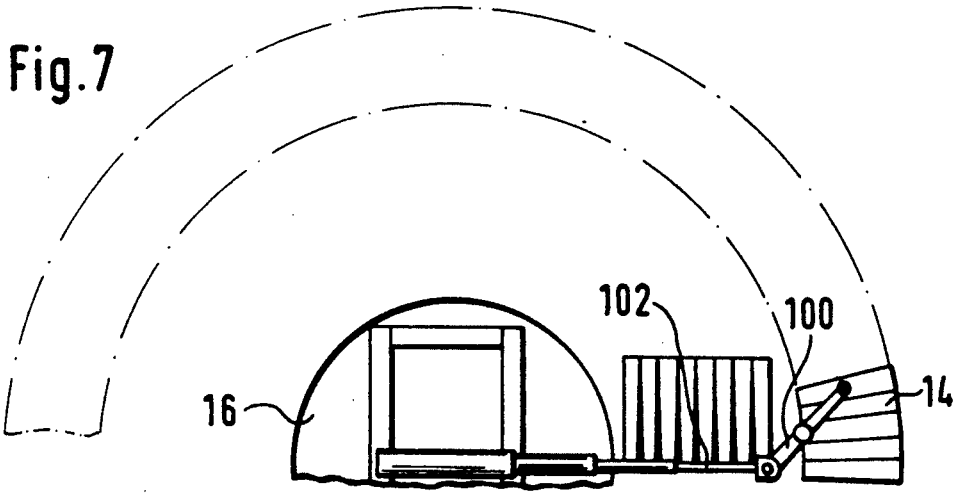
FIG. 7 shows diagrammatically a horizontal section taken above the operating station when the latter is in the widest part of the converter of FIG. 2.

During the bricklaying, the telescopic nature of the boom 102 makes it possible to move the robot 100 radially (see FIGS. 6 and 7) in order to put it in an ideal position for executing the sweeping movement which is necessary for taking hold of and laying the bricks and which is made possible by the three vertical pivot axes.

It should be noted that the boards 42 and 44 together with the pallets of bricks are moved parallel to the movement of the boom 102, so that the bricks are within reach of the suction means 104.

The robot, because of its horizontal movability ensured by the three vertical pivot axes and its vertical movability under the action of the telescopic rod 110, can with the need to move the operating station 16, lay approximately thirty bricks distributed in several spiral rows.

Furthermore, because of the possibility of vertical movement of the suction means 104 under the action of an extension or retraction of the telescopic rod 110, the robot 100 can lay a particular number of rows of bricks and thus cover a height of the order of one metre with masonry, without the need for a vertical movement of the operating station 16, this being illustrated by two different positions represented respectively by thin lines and broken lines at the lower entrance of the converter 10 of FIG. 2.

Figure 4:
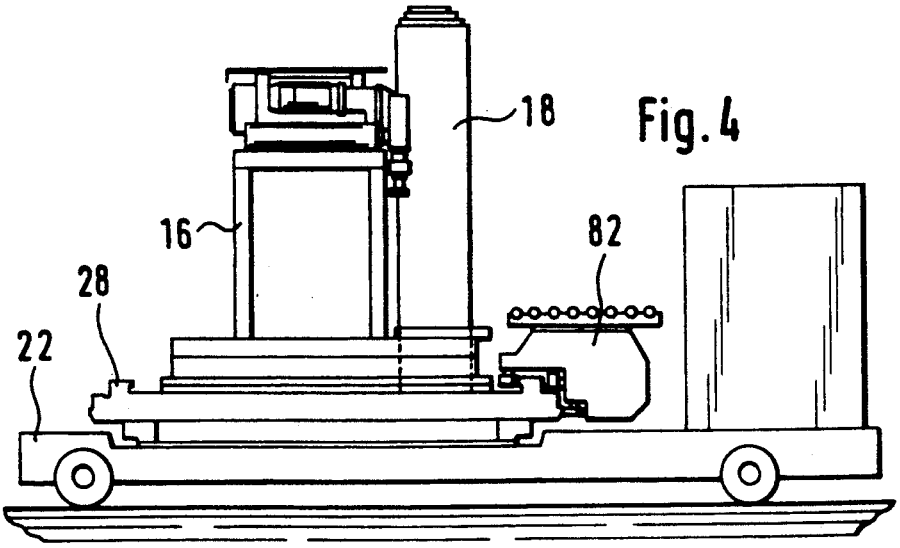
FIG. 4 shows a diagrammatic view of the installation, as it appears during transport.

FIG. 4 illustrates the installation, as it appears for transport. For this purpose, the operating station 16 is detached from its supporting mast 18 and lowered along the latter, by means known per se and not shown, onto the turntable 28 of the trailer 22. In this position, it is sufficient to secure the turntable 28 in order to prevent it from rotating during transport.

Alternatively, it is also possible to mount the mast 18 on a horizontal pivot axle on the turntable 28, so that it can be turned down into a horizontal position for transport, without the need to detach the operating station 16 from the mast 18.

The invention has been described by reference to a loading station and a trailer 22 located under the converter during the laying of the refractory masonry. However, an average person skilled in the art does not depart from the scope of the invention by modifying the installation provided using means easily within his reach, so that the operating station 16 is suspended by means of a telescopic mast on a trailer which is located above the converter and from which pallets will be loaded.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for lining the inner wall of a vessel with bricks, comprising:

a mobile, substantially horizontal base;

a turntable rotatably mounted on the base;

a telescopic mast extending perpendicularly upwardly from a first end to a second end, said first end being secured to the turntable;

a work platform mounted on the second end of the mast, said platform being vertically movable by extension to the mast and being rotationally movable by rotation of the turntable;

retractable means for stabilizing the platform;

storage means for storing two pallets of bricks on the platform;

robot means for handling and laying the bricks;

control means for monitoring and controlling operation of the apparatus; and transport means for raising nd lowering pallets of bricks, said transport means comprising:

a pallet carrier cage, said cage having a lower compartment for receiving full pallets and an upper compartment for receiving empty pallets;

elevator means for receiving at least one pallet carrier cage; and winch means for moving the elevator means between the turntable and the platform; and means for loading and unloading the elevator means, said means for loading and unloading comprising:

guide means circumscribing the turntable; and table means, slidably mounted on the guide means for movement around the turntable.

2. The apparatus of claim 1, wherein the elevator means further comprises a pantograph for lifting the pallets.

3. The apparatus of claim 1, wherein the compartments of the pallet carrier cage further comprise a floor and the floor comprises a sliding track.

4. The apparatus of claim 1, wherein the elevator means further comprises a pair of extensible guide rails and a pair of rolling runners and wherein each runner travels along one of the guide rails.

5. The apparatus of claim 1, wherein the work platform is detachable from the mast.

6. The apparatus of claim 1, wherein the robot means further comprises a horizontal telescopic boom, said boom being radially extendable.

7. The apparatus of claim 6, wherein the robot means further comprises grasping means for grasping at least one brick, and first and second arm segments rotatably joined by a vertical telescopic rod for connecting the grasping means to the boom.

8. The apparatus of claim 6, further comprising means for moving pallets in parallel with the boom.

9. The apparatus of claim 1, wherein the control means is located above the working platform.

* * * * *